US010500515B1

(12) United States Patent
Khachaturian

(10) Patent No.: US 10,500,515 B1
(45) Date of Patent: Dec. 10, 2019

(54) TOY GLIDER

(71) Applicant: Benjamin Khachaturian, Champaign, IL (US)

(72) Inventor: Benjamin Khachaturian, Champaign, IL (US)

( * ) Notice: Subject to any disclaimer, the term of this patent is extended or adjusted under 35 U.S.C. 154(b) by 0 days.

(21) Appl. No.: 15/621,264

(22) Filed: Jun. 13, 2017

Related U.S. Application Data

(60) Provisional application No. 62/349,187, filed on Jun. 13, 2016.

(51) Int. Cl.
*A63H 27/00* (2006.01)

(52) U.S. Cl.
CPC ..... *A63H 27/00* (2013.01)

(58) Field of Classification Search
CPC ..... A63H 27/00
USPC ..... 446/34, 57, 61
See application file for complete search history.

(56) References Cited

U.S. PATENT DOCUMENTS 3,017,139 A * 1/1962 Binder ..... B64C 39/062 244/12.6
3,065,929 A * 11/1962 Holland, Jr. ..... B64C 29/0033 244/12.4
3,154,269 A * 10/1964 Musil ..... B64C 39/062 244/1 R
3,903,639 A * 9/1975 Howell ..... A63H 27/02 244/153 R
3,946,519 A * 3/1976 Vadik ..... A63H 27/00 244/153 R
4,248,007 A * 2/1981 Gamburd ..... A63H 27/00 244/16
4,257,187 A * 3/1981 Waters ..... A63H 27/00 446/64
5,078,636 A * 1/1992 Clarke ..... A63H 33/28 446/15
5,669,803 A * 9/1997 Sweed ..... A63H 27/00 244/154
5,846,111 A * 12/1998 Grimsel ..... A63H 27/08 446/107
6,056,616 A * 5/2000 Bushman ..... A63H 27/00 446/61
6,454,623 B1 * 9/2002 Flatau ..... A63H 33/185 446/34
6,568,980 B2 * 5/2003 Barthold ..... A63H 27/02 446/36
6,607,162 B2 * 8/2003 Warsop ..... B64C 39/062 244/12.6

* cited by examiner

*Primary Examiner* — Joseph B Baldori
(74) *Attorney, Agent, or Firm* — Garvey, Smith & Nehrbass, Patent Attorneys, L.L.C.; Charles C. Garvey, Jr.; Vanessa M. D'Souza

(57) ABSTRACT

A toy glider includes a slim, longitudinally extending strut, fuselage or frame having front and rear end portions. A nose portion is placed at the front end portion. A cylindrically shaped wing is attached to the frame at the nose portion. A tail section is provided at the rear end portion. In one embodiment, the tail section includes a pair of rings (e.g., cylinders) on opposing sides of the fuselage. In another embodiment, the tail section has a horizontal and two inclined components.

24 Claims, 17 Drawing Sheets

TOY GLIDER

CROSS-REFERENCE TO RELATED APPLICATIONS

This application claims benefit of U.S. Provisional Patent Application Ser. No. 62/349,187, filed 13 Jun. 2016, which is hereby incorporated herein by reference.

Priority of U.S. Patent Application Ser. No. 62/349,187, filed 13 Jun. 2016, incorporated herein by reference, is hereby claimed.

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The present invention relates to toy gliders. More particularly, the present invention relates to a toy glider having a fuselage or frame (e.g., balsa wood, foam, carbon, composite or plastic) that supports a ring or generally cylindrically shaped wing and having a tail section (of foam, composite, carbon, plastic or other light weight material) at the rear of the frame, in one embodiment the tail section including spaced apart ring like structures. In one embodiment, the glider is motorized (i.e., motor and propeller).

2. General Background of the Invention

Toy gliders are devices powered by thrusting forward movement of a user's arm or by other manual launcher (e.g., rubber band, slingshot or the like).

BRIEF SUMMARY OF THE INVENTION

The present invention is for a toy glider that includes a longitudinally extending fuselage, strut or frame preferably having front and rear end portions. A weighted or shock absorbing nose portion can be placed preferably at the front end portion of the fuselage. A ring shape or cylindrically shaped wing is preferably attached to a forward end portion of the frame (e.g., next to the nose portion). A tail section is provided preferably at the rear end portion of the fuselage. The tail section preferably includes opposed rings or cylinders. The tail section can have a width preferably greater than or about equal to the wing diameter. In one embodiment, the tail section preferably has a generally U-shape.

BRIEF DESCRIPTION OF THE SEVERAL VIEWS OF THE DRAWINGS

For a further understanding of the nature, objects, and advantages of the present invention, reference should be had to the following detailed description, read in conjunction with the following drawings, wherein like reference numerals denote like elements and wherein.

DETAILED DESCRIPTION OF THE INVENTION

Figure 1:
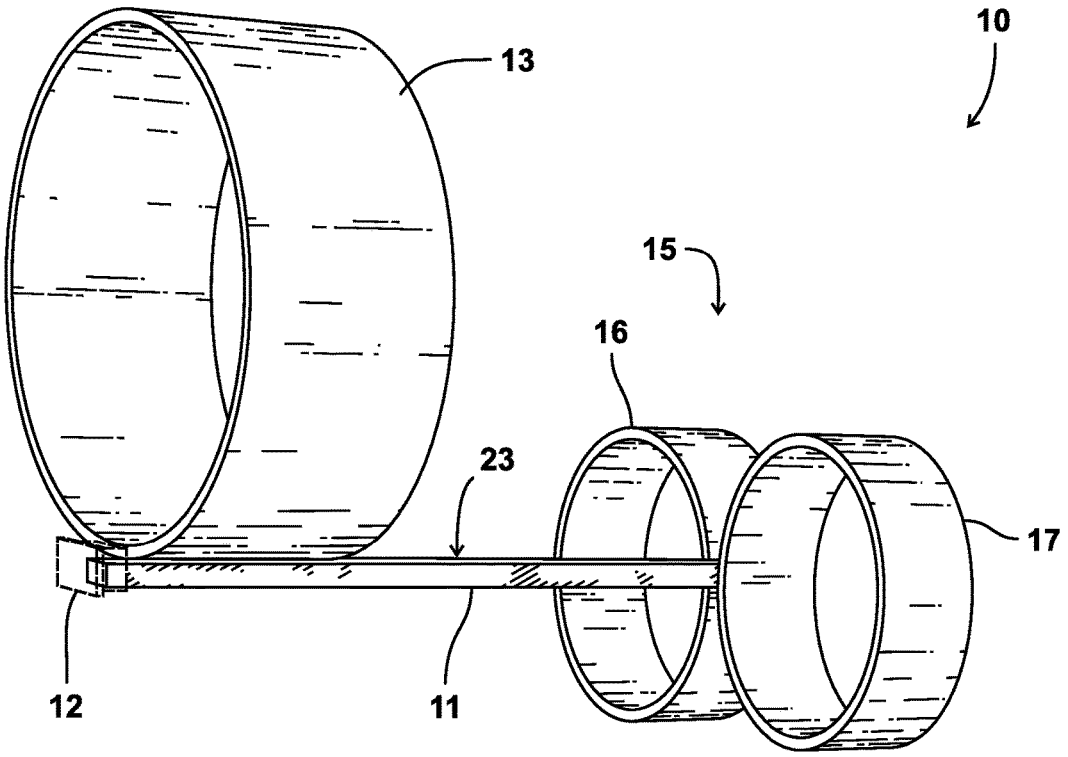
FIG. 1 is a perspective view of a preferred embodiment of the apparatus of the present invention.
Figure 24:
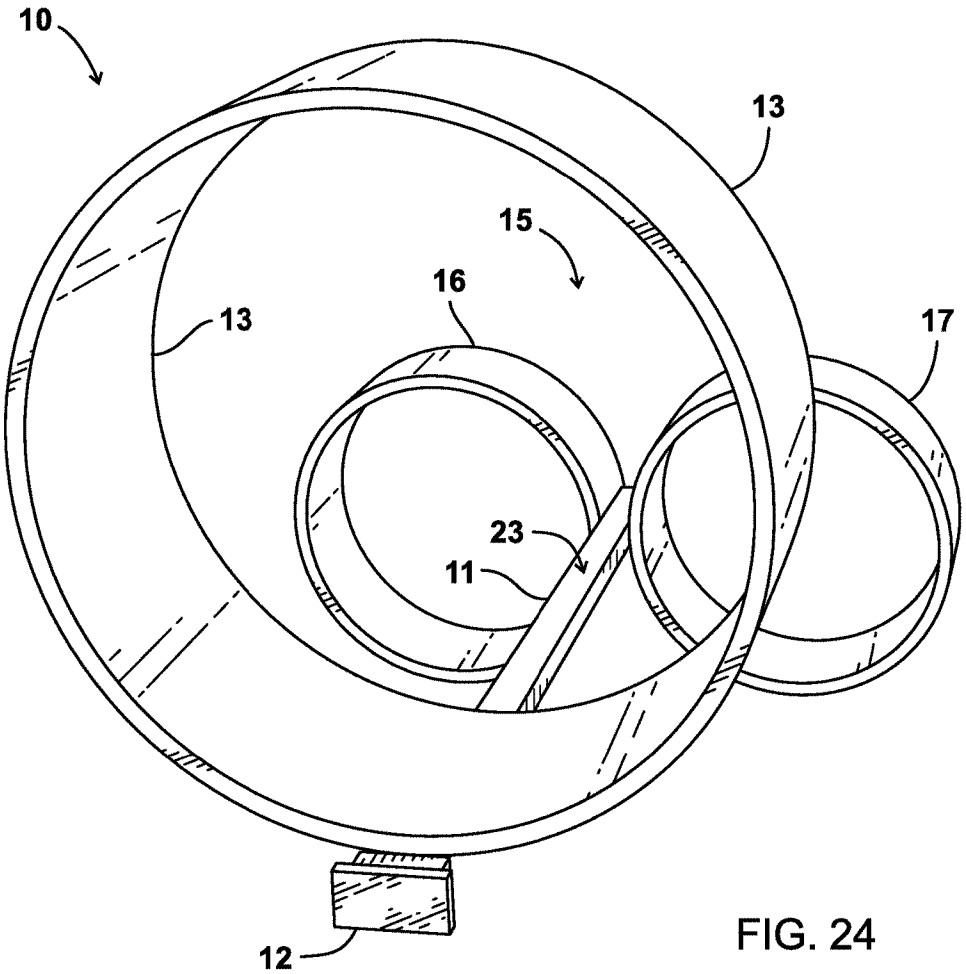
FIG. 24 is a perspective view of a preferred embodiment of the apparatus of the present invention.

FIGS. 1 and 24 are perspective views of the toy glider 10 of the present invention. Glider 10 provides an elongated fuselage, frame, spar, beam or bar 11 which can be an elongated lightweight rod or bar, such as of plastic, foam, carbon, composite, or balsa wood. Fuselage 11 preferably has central, longitudinal axis 28.

Mounted to the front or forward section of elongated or longitudinally extending frame 11 is nose section, weighted nose, or shock absorbing bumper 12 (e.g., foam or rubber). Nose section 12 can be a cube shape or a sphere with a socket 49 that is sized and shaped to connect with fuselage 11 and a front surface 51 (e.g., that is flat). Attached to elongated frame 11 next to bumper or nose 12 is cylindrically or ring shaped wing 13 having diameter 14 (diameter 18 in FIG. 4). In a preferred embodiment of the present invention, the front wing 13 can be structurally self supporting. The wing 13 can be made of plastic, carbon, foam, styrofoam, or balsa wood, and/or could be a frame (e.g., wood or plastic) covered with fabric or paper that can be self supporting. Fabric covering can be of lightweight material such as nylon fabric or any other material suitable for toy gliders or kites. Wing 13 can be attached to an upper surface 23 of frame/fuselage 11 with a fastener(s) or adhesive.

Figure 4:
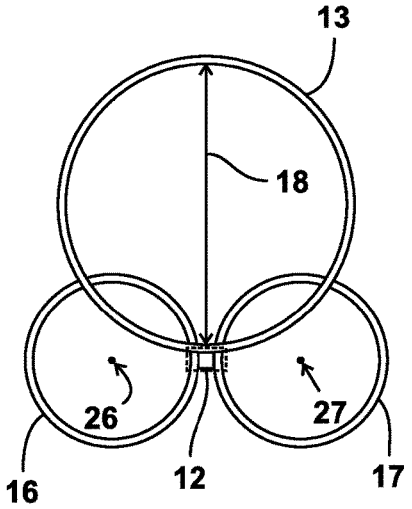
FIG. 4 is a front view of a preferred embodiment of the apparatus of the present invention.
Figure 5:
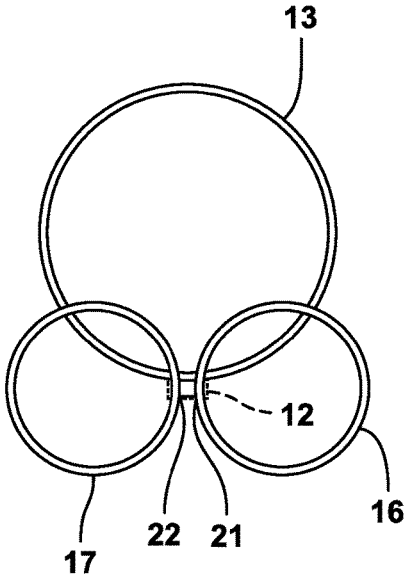
FIG. 5 is a rear view of a preferred embodiment of the apparatus of the present invention.

Tail section 15 includes tail rings 16 and 17 which can be generally cylindrically shaped. The tail section rings 16, 17 can be attached to a side surface 24, 25 of the frame/fuselage 11 using a fastener or fasteners or an adhesive. Ring 16 can be attached to side surface 24. Ring 17 can be attached to side surface 25. Each ring 16, 17 can have a center or central axis at 26 or 27 as seen in FIG. 4. A line drawn from center 26 to center 27 intersects the central longitudinal axis 28 of fuselage 11.

Figure 2:
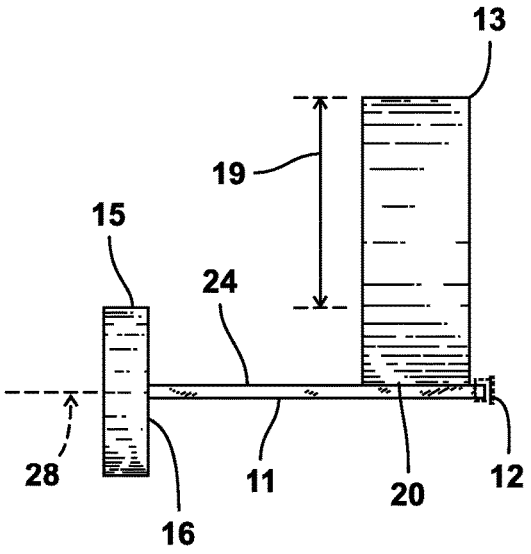
FIG. 2 is a side view of a preferred embodiment of the apparatus of the present invention.
Figure 3:
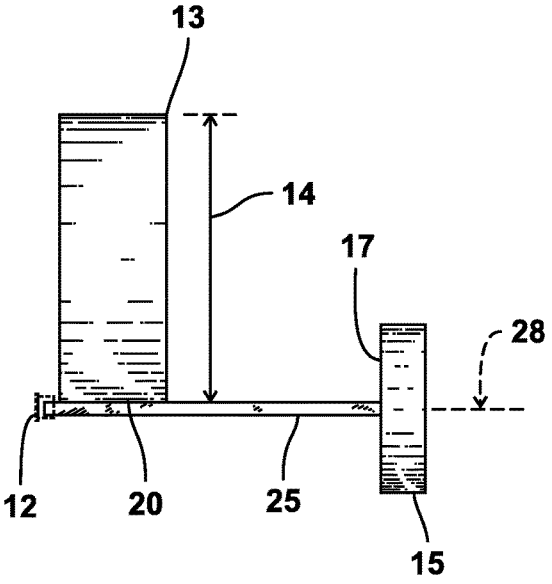
FIG. 3 is a side view of a preferred embodiment of the apparatus of the present invention.
Figure 6:
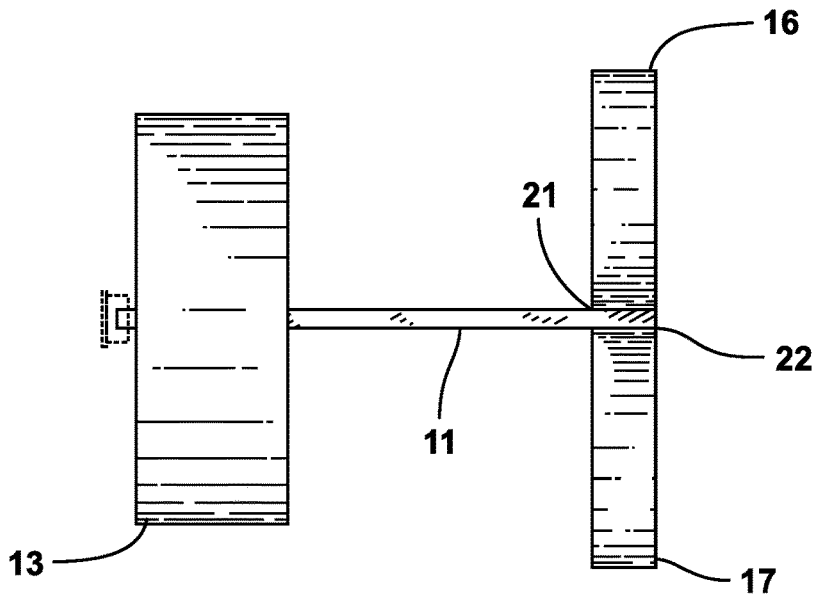
FIG. 6 is a top view of a preferred embodiment of the apparatus of the present invention.
Figure 7:
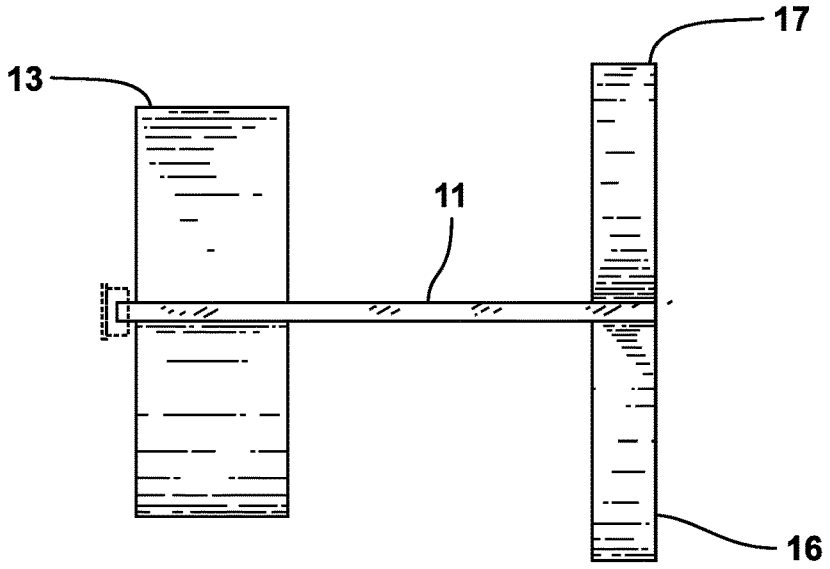
FIG. 7 is a bottom view of a preferred embodiment of the apparatus of the present invention.
Figure 8:
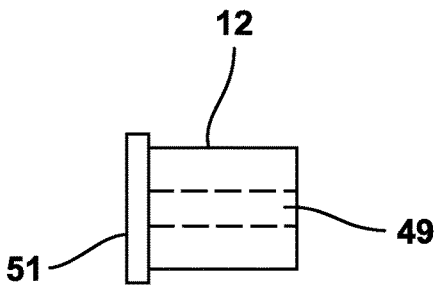
FIGS. 8-10 are fragmentary views illustrating the noseweight/bumper of a preferred embodiment of the apparatus of the present invention.
Figure 9:
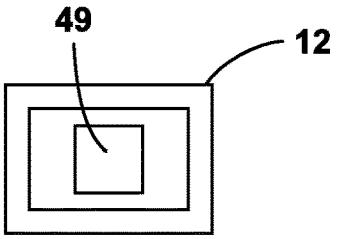
Figure 10:
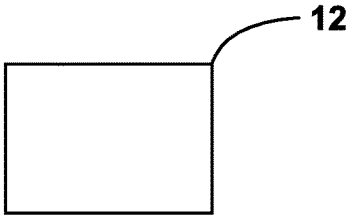
Figure 11:
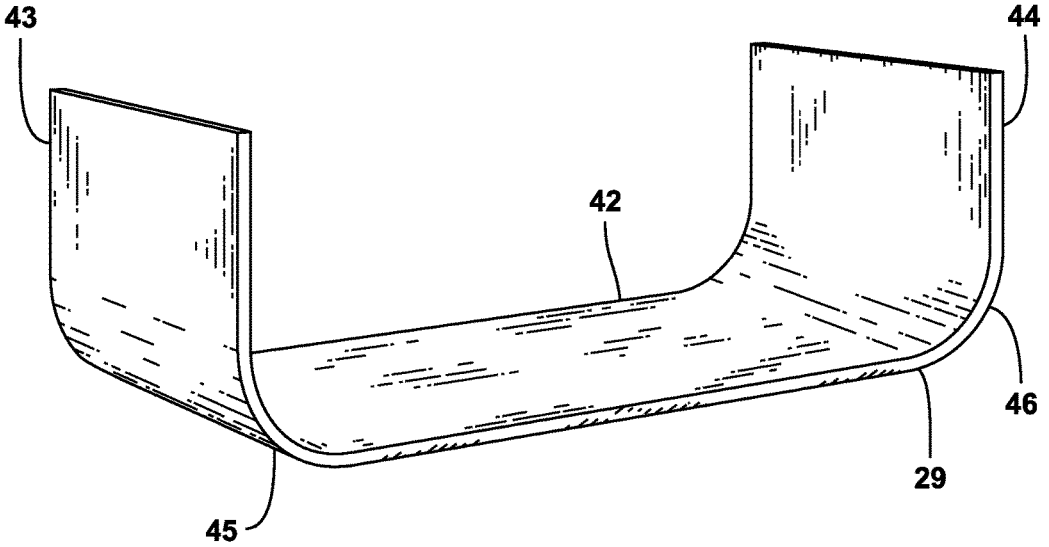
FIG. 11 is a perspective view of an alternate arrangement for the tail section of a preferred embodiment of the apparatus of the present invention.
Figure 12:
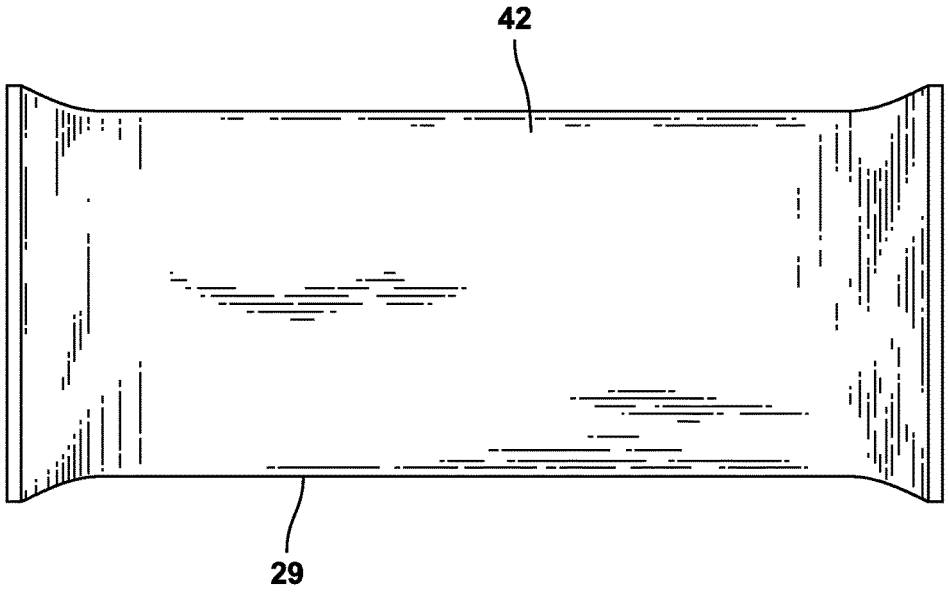
FIG. 12 is a top view of the tail section of FIG. 11.
Figure 13:
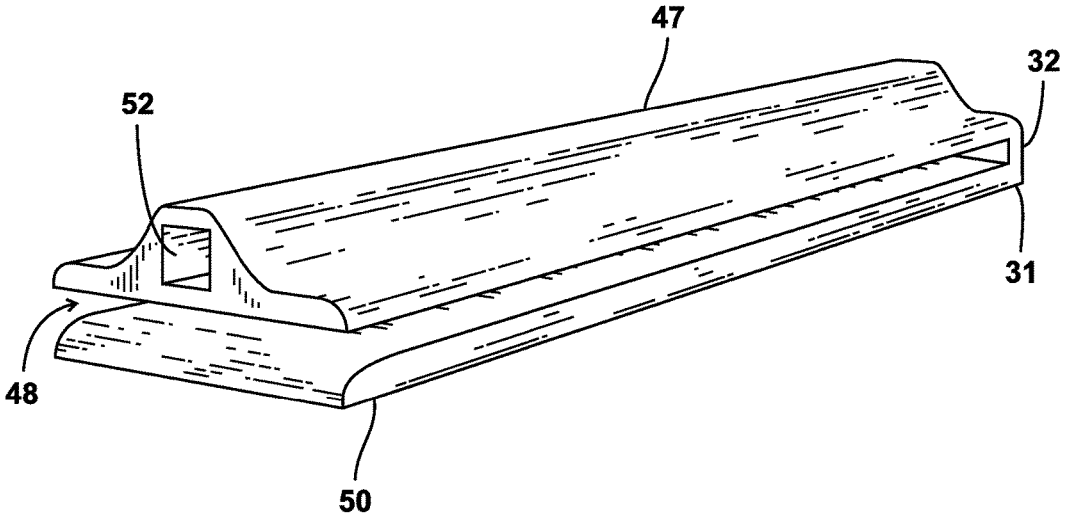
FIG. 13 is a fragmentary view of a tail bracket of an alternate embodiment of a preferred embodiment of the apparatus of the present invention.
Figure 20:
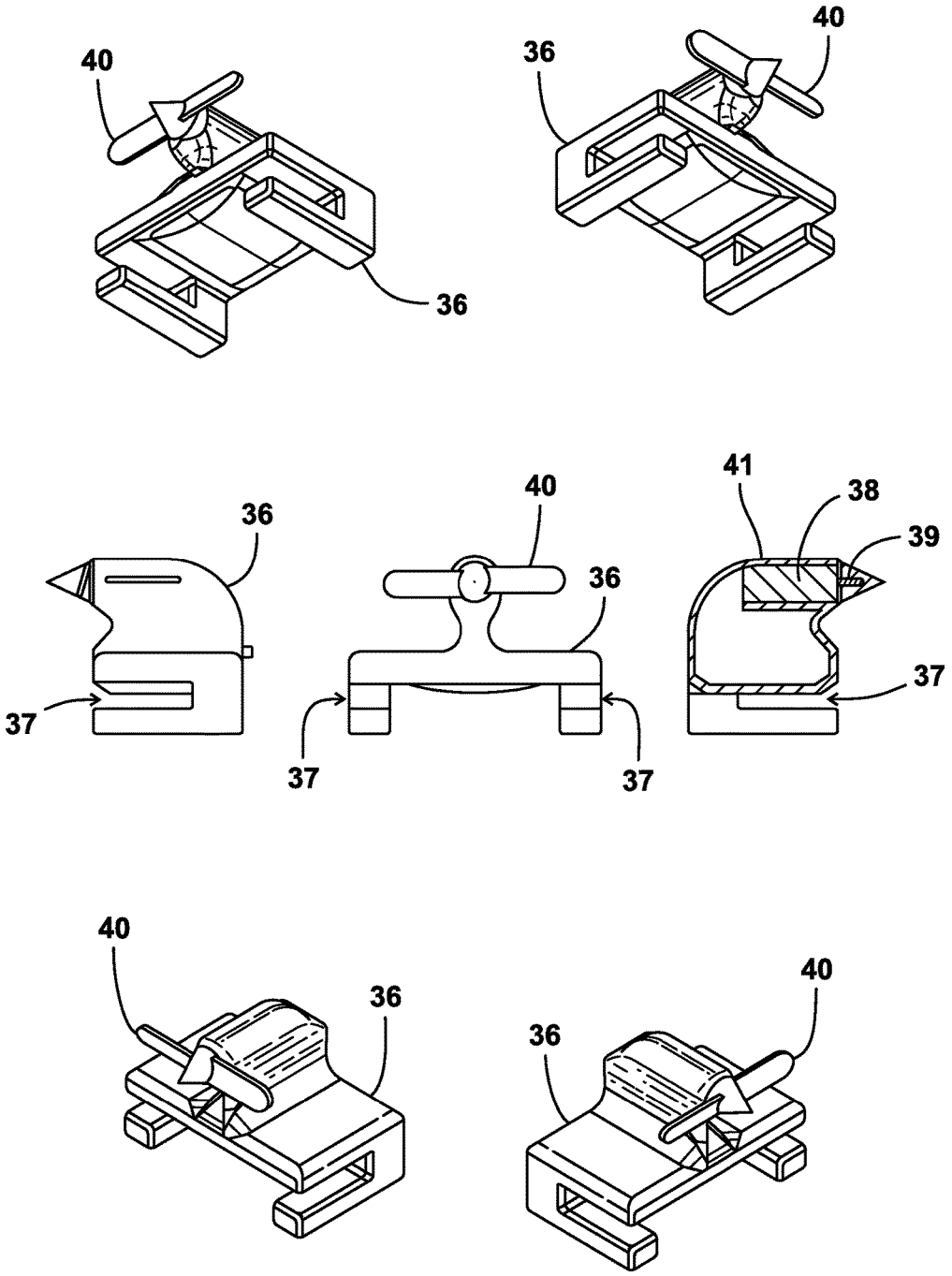
FIGS. 20-23 are views illustrating an alternate embodiment with motor and propeller arrangement.

In FIG. 2, the dimension 19 illustrates the distance between the top of the tail section 15 and the top of the forward wing 13. In FIGS. 2 and 3, 20 illustrates an attachment of ring wing 13 to the frame, spar, beam or fuselage 11. In FIG. 6, the numeral 21 is an attachment of tail ring 16 to fuselage 11. In FIG. 6, the numeral 22 is an attachment of tail ring 17 to fuselage 11.

Figure 14:
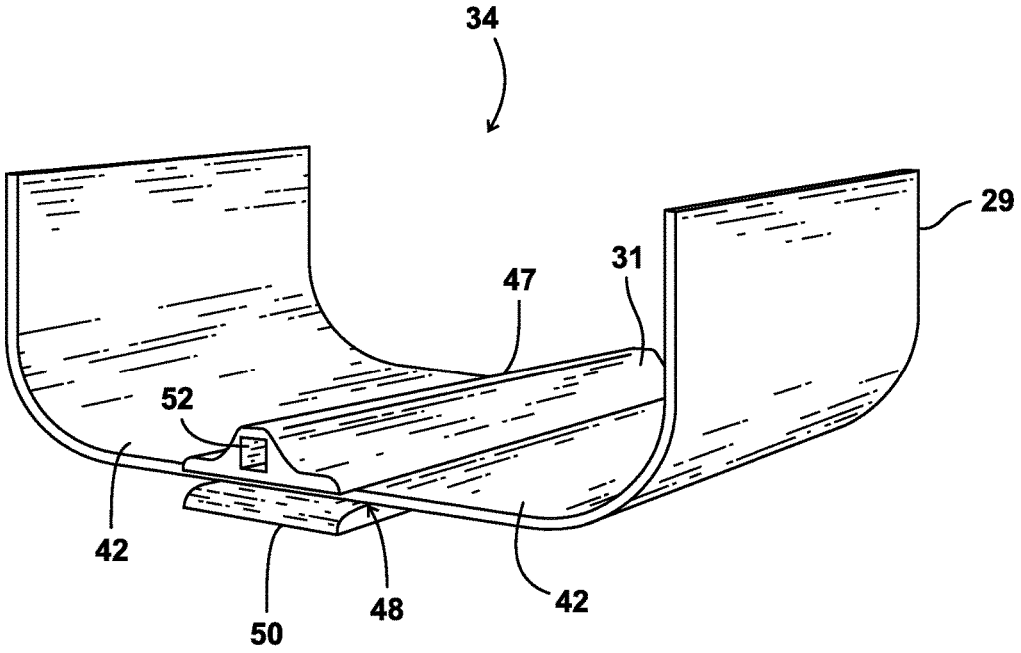
FIG. 14 is a perspective fragmentary view of an alternate embodiment of the tail section of a preferred embodiment of the apparatus of the present invention.
Figure 15:
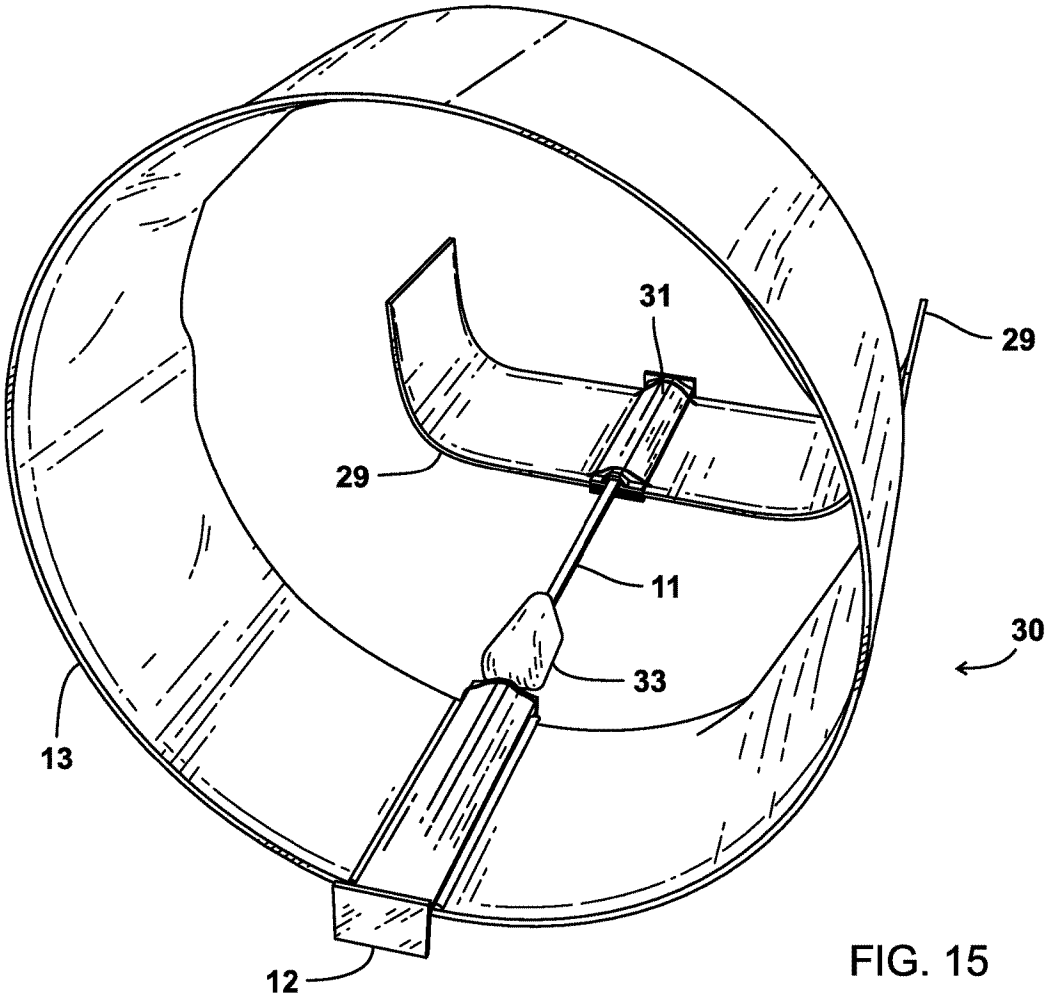
FIG. 15 is a perspective view of an alternate embodiment of a preferred embodiment of the apparatus of the present invention.
Figure 16:
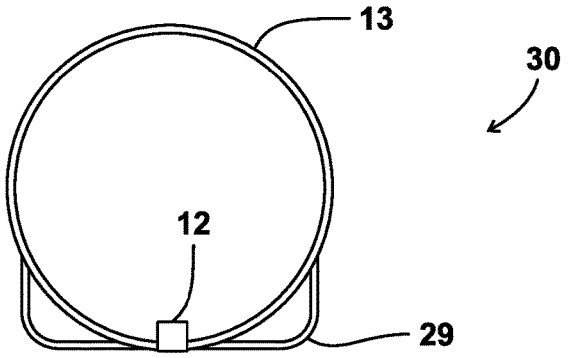
FIG. 16 is a front view of an alternate embodiment of a preferred embodiment of the apparatus of the present invention.
Figure 17:
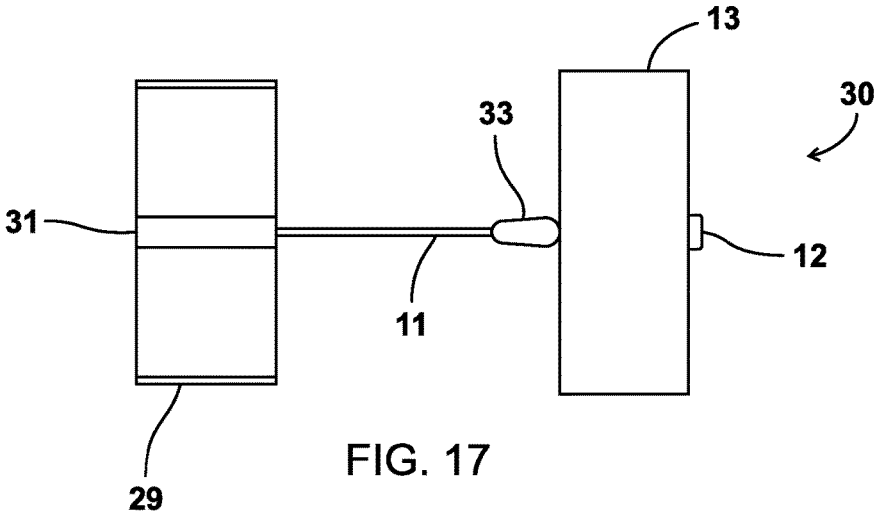
FIG. 17 is a top view of an alternate embodiment of a preferred embodiment of the apparatus of the present invention.
Figure 18:
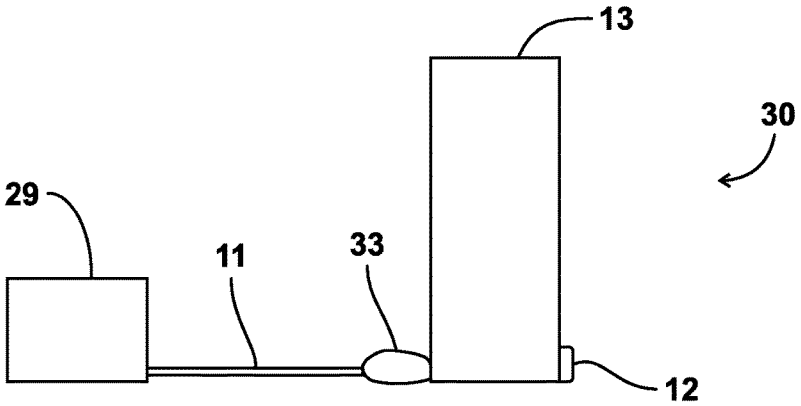
FIG. 18 is a side view of an alternate embodiment of a preferred embodiment of the apparatus of the present invention.
Figure 19:
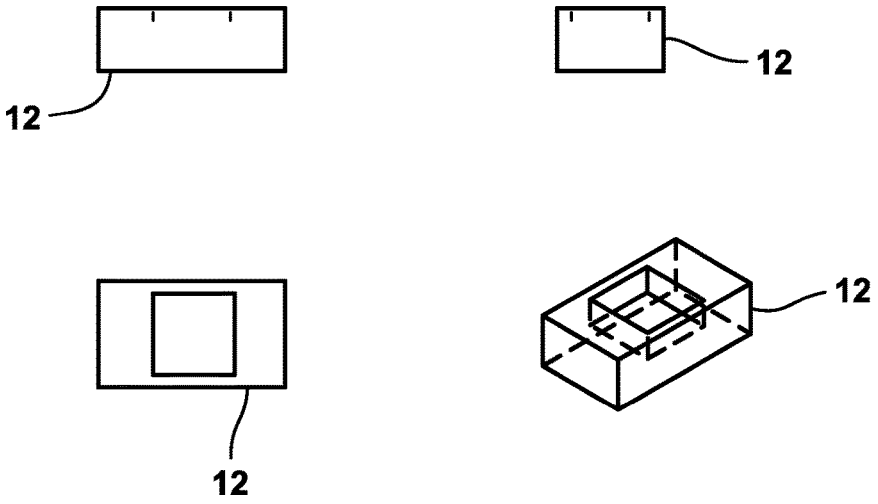
FIG. 19 shows fragmentary views that illustrate a preferred embodiment of the noseweight of the apparatus of the present invention.

FIGS. 11-18 show an alternate embodiment (designated by the numeral 30) wherein a U-shaped tail 29 is provided. Glider 30, tail section 29 can have a horizontal section 42, a pair of inclined sections 43, 44 and curved sections 45, 46 as seen in FIGS. 11-18. Tail 29 horizontal section 42 fits slot 48 of bracket 31 (see FIG. 14). Bracket 31 has upper section 47, lower section 50, and socket 52 (see FIG. 14) that is receptive of fuselage 11 (see FIG. 15). Stop 32 on bracket 31 affixes position of tail section 29 relative to bracket 31 when the tail section 29 is inserted into slot 48. The assembled positions of tail section 29 and bracket 31 are seen in FIG. 14 and designated as tail assembly 34. Handle 33 can be mounted on fuselage 11. Handle 33 can be moved along fuselage 11 between wing 13 and tail bracket 31.

The following list contains examples of dimensions for one embodiment:

Front Ring 13: 30 in×4 in×6 mm (76.2 cm×10.16 cm×6 mm), (9.55 in (24.257 cm) in diameter)

Tail Rings 16, 17: 18 in×2 in×6 mm (45.72 cm×5.08 cm×6 mm), (5.73 in (14.554 cm) in diameter)

Fuselage 11: 15 in×0.5 in×0.5 in (38.1 cm×1.27 cm×1.27 cm)

Noseweight 12: 30 mm×17 mm×10 mm

Protective Nose: 1.5 in×0.75 in×6 mm (3.81 cm×1.905 cm×6 mm)

In one embodiment, all foam pieces, including the rings 13, 16, 17 and nose 12, can be preferably 6 mm thick white EPP foam (0.24 in).

Material Examples

In one embodiment of the present invention, the fuselage 11 can be made of balsa wood.

In one embodiment of the present invention, the rings, 13, 16, 17 can be made of EPP (Expanded Poly-Propylene) Foam.

In one embodiment of the present invention, the noseweight 12 can be made of ABS plastic and has a weight of about 5.5 grams.

In one embodiment of the present invention, the protective nose can be made of EPP (Expanded Poly-Propylene) Foam.

Attachments/Adhesive Examples

In a preferred embodiment of the present invention, the rings 13, 16, 17 can be attached to the fuselage 11 using single sided adhesive tape and double sided adhesive tape.

In a preferred embodiment of the present invention, the noseweight 12 can be attached to the fuselage 11 physically by pushing the fuselage 11 into an indentation in the noseweight 12. Glue can be placed into the indentation to strengthen the bond. The foam protective nose can be attached to the noseweight 12 using double sided tape.

Weight Examples

In a preferred embodiment of the present invention, the front ring 13, made of EPP foam, can weigh approximately 9 grams.

In a preferred embodiment of the present invention, the combined back rings 16, 17, made of EPP foam, can weigh approximately 5 grams.

In a preferred embodiment of the present invention, the fuselage 11 can weigh approximately 5 grams without double sided tape.

In a preferred embodiment of the present invention, the weight of the tape bonding the rings 13, 16, 17 to the fuselage 11 and the noseweight can be about 4 grams.

In a preferred embodiment of the present invention, the noseweight can weigh about 5.5 grams.

In a preferred embodiment, the total weight of the apparatus of the present invention can be between about 25 and 30 grams.

In Various Preferred Embodiments of the Present Invention, the Following are Examples of Ratios of the Best Flying Apparatus:

Front Ring 13 to Tail Ring 16, 17 circumference: 30:18 (circumference) 9.55:5.73 (diameter)

Total Width of tail rings 16, 17 to Front Ring 13 width: about 12:9.5

Total length of fuselage 11 to depth/width of front ring 13: about 15:4

Total length of fuselage 11 to depth/width of tail ring 16, 17: about 15:2

Depth of front ring 13 to depth of tail ring 16, 17: about 2:1

Other Suitable Material Examples: (Specifications and Materials)

In various preferred embodiments of the present invention, the fuselage 11 can be made out of balsa, bass, plywood, oak, cherry, pine, or a synthetic or composite wood. In various preferred embodiments of the present invention, the fuselage 11 could also be made of carbon fiber, plastic, or hollow plastic. These plastics may include ABS, LDPE, HDPE, Styrene or a composite plastic. The fuselage 11 could also be made of foam including EPP, Depron, a polypropylene foam, or a composite foam.

Rings:

In various preferred embodiments of the present invention, the rings could be made of EPP (Expanded Poly-Propylene) Foam, lightweight fabric, lightweight plastic sheet that could be made of styrene, ABS, or LDPE. In various preferred embodiments of the present invention, other types of foam may be used for the rings including EVA, Depron, or a composite foam. In various preferred embodiments of the present invention, the rings may be found in a different color including Red, Green, Blue, Yellow, Orange, Purple, Pink, Gray, Black, or a mixture, combination, or certain hue of these colors.

Noseweight:

In various preferred embodiments of the present invention, the noseweight 12 could be made of plastic made of ABS, LDPE, HDPE, Styrene, or a composite plastic. In various preferred embodiments of the present invention, the noseweight could be metal in the form of steel, aluminum, copper, brass, tin, or a composite metal. In various preferred embodiments of the present invention, the noseweight may also be a composite foam material. In various preferred embodiments of the present invention, the noseweight can be found in a variety of colors including Red, Green, Blue, Yellow, Orange, Purple, Pink, Gray, Black, or a mixture, combination, or certain hue of these colors.

Protective Nose:

In various preferred embodiments of the present invention, the protective nose 12 could be made of foam, rubber, plastic, a composite plastic material, or a composite foam material. In various preferred embodiments of the present invention, the protective nose can be made in a variety of colors including Red, Green, Blue, Yellow, Orange, Purple, Pink, Gray, Black, or a mixture, combination, or certain hue of these colors.

In Various Preferred Embodiments of the Present Invention, the Following are Examples of Ratios that could be Used:

Front Ring 13 to Tail Ring 16, 17 circumference is between about 1.25:1 and 10:1.

Total Width of tail rings 16, 17 to Front Ring 13 width is between about 0.5:1 to 10:1

Total length of fuselage 11 to depth/width of front ring 13 is between about 2:1 and 10:1.

Total length of fuselage 11 to depth/width of tail ring 16, 17 is between about 2:1 and 20:1

Depth of front ring 13 to depth of tail ring 16, 17 is between about 1:1 and 10:1.

Attachment Examples

Figure 21:
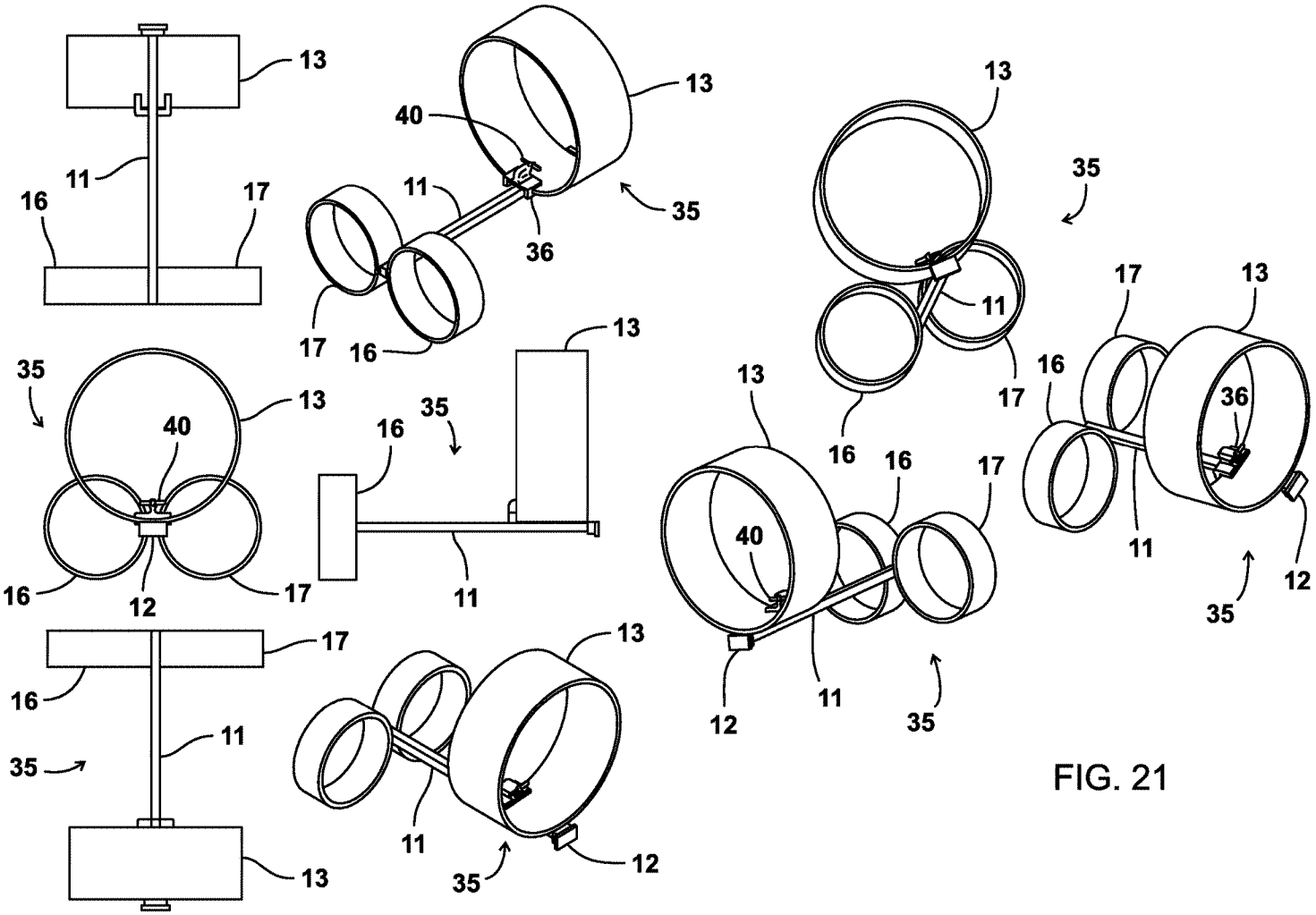
Figure 22:
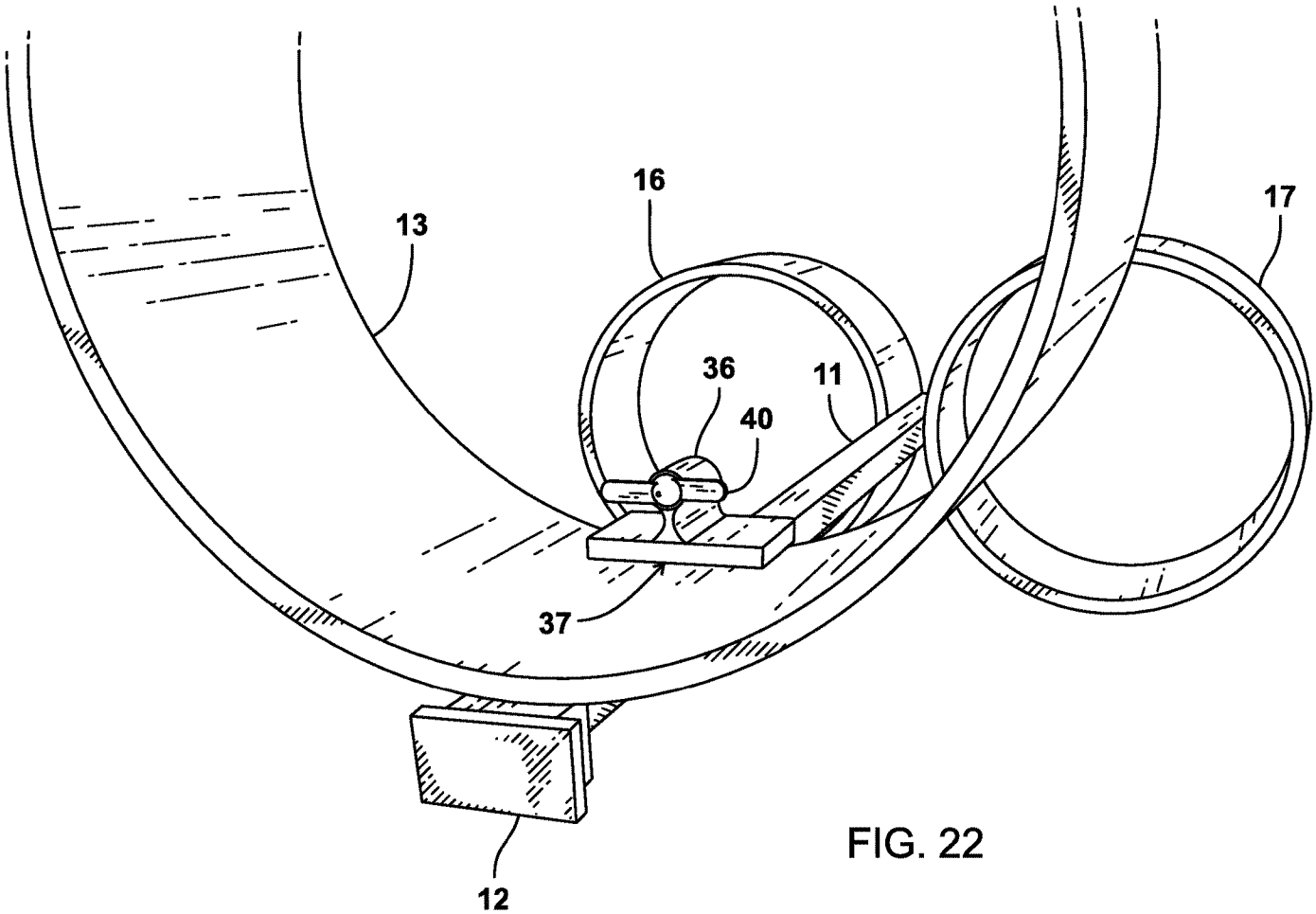
Figure 23:
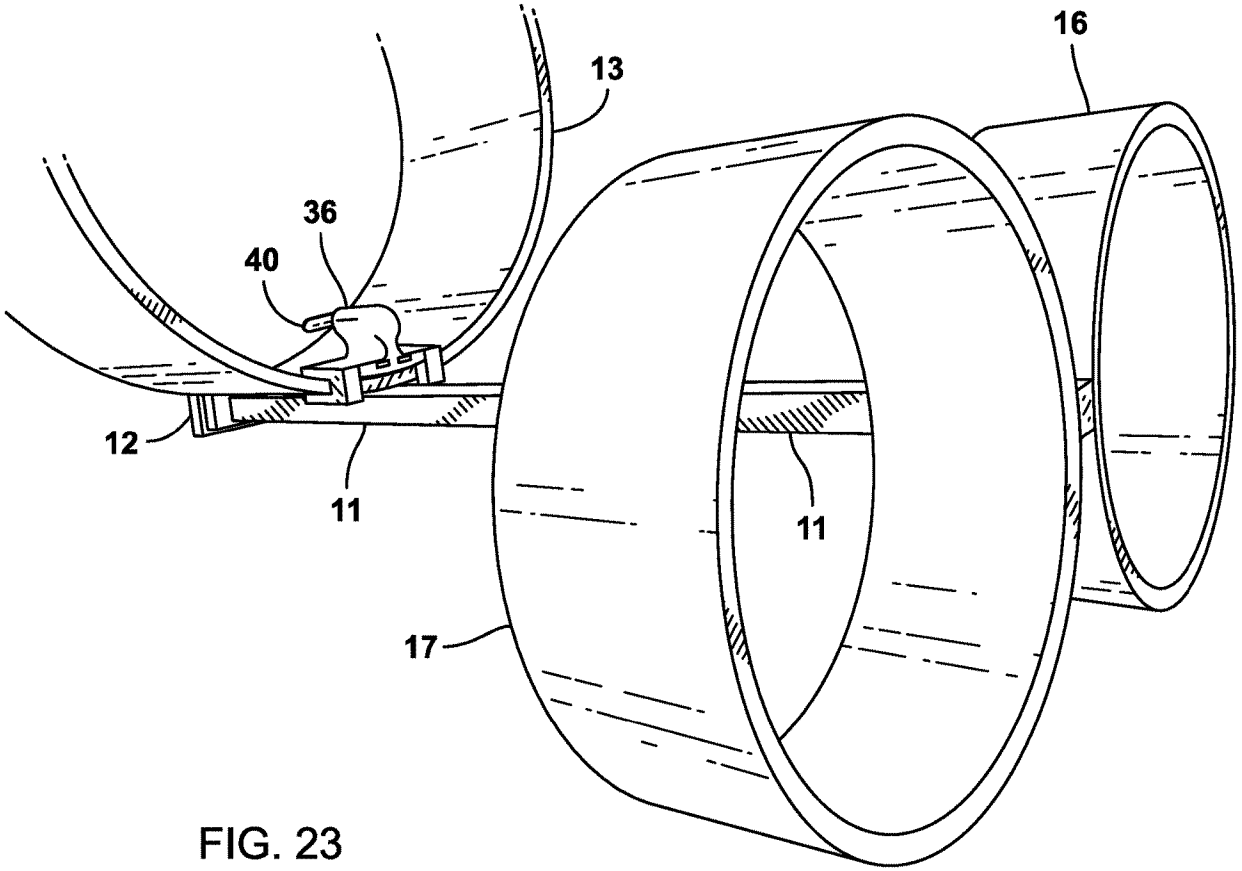

The rings 13, 16, 17 and protective nose 12 may be attached to the fuselage 11 using single sided adhesive tape and double sided adhesive tape, or may also be attached using Velcro fasteners, glue, or another adhesive. The noseweight 12 may be attached with a physical indentation or no indentation at all. The noseweight 12 may protrude physically into the fuselage 11 in the case that the fuselage 11 is made of hollow plastic. In the event that the fuselage 11 is made of plastic, the noseweight 12 may be unified with the fuselage 11 into a single fuselage and noseweight piece. Attachment may not be necessary in the case the rings 13, 16, 17 are molded with the fuselage 11 in one piece FIGS. 20-23 show an alternate embodiment of the apparatus of the present invention designated generally by the numeral 35. In FIGS. 20-23, toy glider 35 has an elongated frame, spar, beam or fuselage 11 as with the embodiment of FIGS. 1-19. As with the embodiment of FIGS. 1-19, the toy glider 35 has ring or wing 13 and tail section 15 with tail rings 16, 17. Motor support 36 attaches to forward ring or wing 13 as seen in FIGS. 21-22. Motor support 36 can be seen in more detail in FIG. 20. The motor support 36 has slots 37 that are sized and shaped to fit and connect with wing 13 as seen in FIGS. 22 and 23. Motor 38 attaches to motor support 36 at bore 41. Motor 38 can have an outer surface that is generally cylindrically shaped. Bore 41 can be cylindrically shaped to receive motor 36 therein. Adhesive or other means can be used to connect motor 38 with motor support 36 at bore 41. Motor 38 has drive shaft 39 and propeller 40 as shown in FIGS. 20 and 22. The motor 38 can be a battery powered motor for example.

Although a preferred embodiment is comprised of three rings, the design may vary with one front ring 13 and a U shaped tail 29. The apparatus of the present invention may contain multiple different embodiments and materials but may also contain only one for example. The apparatus of the present invention could also be made of injection molded material (e.g., plastic or foam) in one piece.

The following is a list of parts and materials suitable for use in the present invention:

PARTS LIST:

| PART NUMBER | DESCRIPTION |
|---|---|
| 10 | toy glider |
| 11 | elongated frame, spar, beam, fuselage, bar |
| 12 | nose/bumper/protective nose/no seweight |
| 13 | ring/cylindrically shaped forward wing |
| 14 | ring/wing diameter |
| 15 | tail section |
| 16 | tail ring |
| 17 | tail ring |
| 18 | ring diameter |
| 19 | dimension |
| 20 | attachment |
| 21 | attachment |
| 22 | attachment |
| 23 | upper surface |
| 24 | side surface |
| 25 | side surface |
| 26 | tail ring central axis/center |
| 27 | tail ring central axis/center |
| 28 | central longitudinal axis |
| 29 | U shaped tail |
| 30 | glider |
| 31 | tail bracket |
| 32 | stop |
| 33 | handle |
| 34 | tail assembly |
| 35 | toy glider |
| 36 | motor support |
| 37 | slot |
| 38 | motor |
| 39 | drive shaft |
| 40 | propeller |
| 41 | cylindrical bore/bore |
| 42 | horizontal section |
| 43 | inclined/vertical section |
| 44 | inclined/vertical section |
| 45 | curved section |
| 46 | curved section |
| 47 | bracket upper section |
| 48 | slot |
| 49 | socket |
| 50 | bracket lower section |
| 51 | front surface |
| 52 | socket |

All measurements disclosed herein are at standard temperature and pressure, at sea level on Earth, unless indicated otherwise. All materials used or intended to be used in a human being are biocompatible, unless indicated otherwise.

The foregoing embodiments are presented by way of example only; the scope of the present invention is to be limited only by the following claims.

The invention claimed is:

1. A toy glider, comprising:

a) a longitudinally extending fuselage having a front end, a rear end, an upper surface, a lower surface, a left side surface and a right side surface;

b) a nose portion connected to said front end;

c) a structurally self supporting, front ring shaped wing having a curved outer surface and attached to the fuselage upper surface at an attachment that abuts said curved outer surface with said fuselage upper surface, said front ring shaped wing extending upwardly from the fuselage upper surface at a position next to said nose portion;

d) a tail section that extends to said rear end of said fuselage and spaced away from said front ring shaped wing, said tail section including a first tail ring and a second tail ring, each said tail ring having a curved outer surface, wherein said tail rings are placed on opposing sides of said fuselage;

e) wherein the first tail ring curved outer surface is attached to and abuts the fuselage right side surface at a first attachment location;

f) wherein the second tail ring curved outer surface is attached to and abuts the fuselage left side surface at a second attachment location;

g) wherein each said first and second tail rings extend both above and below the fuselage and above and below said first and second attachment locations;

h) wherein the front ring shaped wing has a wing diameter; and i) wherein the tail section has a width that is equal to said wing diameter.

2. The toy glider of claim 1 wherein the front ring shaped wing is comprised of a fabric or paper covered structure that is self supporting.

3. The toy glider of claim 1 wherein the tail section is comprised of a foam material.

4. The toy glider of claim 1, wherein the front ring shaped wing has a length and the wing diameter is greater than said length.

5. The toy glider of claim 1 wherein the nose portion is of a foam material.

6. The toy glider of claim 1 wherein the nose portion is of a polymeric material.

7. The toy glider of claim 1 wherein the nose portion is of a rubber material.

8. The toy glider of claim 1 wherein the first and second tail rings are each of a diameter that is less than the wing diameter.

9. The toy glider of claim 1 wherein the fuselage has a fore to aft fuselage length and the nose portion extends only a part of said fuselage length.

10. The toy glider of claim 1 further comprising a motor and propeller mounted to the front ring shaped wing.

11. The toy glider of claim 1 wherein each said tail ring extends rearwardly to said fuselage rear end.

12. The toy glider of claim 1 wherein each said tail ring extends equal distances above the fuselage and below the fuselage.

13. A toy glider, comprising:

a) a longitudinally extending fuselage having a front end, a rear end, an upper surface, a lower surface, a right side surface and a left side surface;

b) a shock absorbing nose portion connected to said front end;

c) a structurally self supporting, front ring shaped wing attached to said fuselage at a front wing attachment, said front ring shaped wing extending above the fuselage next to the nose portion wherein said front ring shaped wing has an outer generally cylindrically shaped front wing outer surface;

d) wherein said front wing outer surface abuts said fuselage upper surface at said front wing attachment;

e) a tail section that extends to the fuselage rear end and spaced away from said front ring shaped wing, said tail section including first and second tail ring shaped members attached to said side surfaces of said fuselage at respective first and second tail ring attachment locations, each said tail ring shaped member having a generally cylindrically shaped outer tail ring surface;

f) each said tail ring shaped member extending both above and below said first and second tail ring attachment locations, wherein each said tail ring shaped member outer surface abutting said fuselage at a said tail ring attachment location;

g) wherein the front ring shaped wing has a wing diameter; and h) wherein the first and second tail ring members each have a diameter that is smaller than the wing diameter.

14. The toy glider of claim 13 wherein the front ring shaped wing is comprised of a fabric or paper covered structure that is self supporting.

15. The toy glider of claim 13 wherein the tail section is comprised of a foam material.

16. The toy glider of claim 13, wherein the tail section has a width and the wing diameter is less than the tail section width.

17. The toy glider of claim 13, wherein the front ring shaped wing has a length and the wing diameter is greater than said length.

18. The toy glider of claim 13 wherein the nose portion is of a foam material.

19. The toy glider of claim 13 wherein the nose portion is of a polymeric material.

20. The toy glider of claim 13 wherein the nose portion is of a rubber material.

21. The toy glider of claim 13 wherein the fuselage has a fore to aft length and the nose portion extends only a part of said length.

22. The toy glider of claim 13 further comprising a motor and propeller mounted to the front ring shaped wing.

23. The toy glider of claim 13 wherein each said tail ring shaped member extends rearwardly to said fuselage rear end.

24. The toy glider of claim 13 wherein each said tail ring shaped member extends about equal distances above the fuselage and below the fuselage.

* * * * *